US005436704A

United States Patent [19]

Moon

[11] Patent Number: 5,436,704

[45] Date of Patent: Jul. 25, 1995

[54] DEVICE FOR SENSING THE AMOUNT OF RESIDUAL TONER OF DEVELOPING APPARATUS

[75] Inventor: Young-Soo Moon, Seoul, Rep. of Korea

[73] Assignee: SamSung Electronics Co., Ltd., Suwon, Japan

[21] Appl. No.: 250,621

[22] Filed: May 27, 1994

[30] Foreign Application Priority Data

May 31, 1993 [KR] Rep. of Korea ..... 9478/1993

[51] Int. Cl.[6] ..... G03G 13/08

[52] U.S. Cl. ..... 355/245; 355/206; 355/246; 355/259

[58] Field of Search ..... 355/245, 246, 206, 251, 355/253, 259, 260; 118/653, 656, 657, 658

[56] References Cited

U.S. PATENT DOCUMENTS

| | | | |
|---|---|---|---|
| 4,951,091 | 8/1990 | Nawata . | |
| 4,963,929 | 10/1990 | Ueda et al. . | |
| 5,035,198 | 7/1991 | Niito | 355/246 X |
| 5,045,884 | 9/1991 | Ohira et al. | 355/245 |
| 5,068,691 | 11/1991 | Nishio et al. | 355/259 |
| 5,214,475 | 5/1993 | Ishii et al. . | |
| 5,239,346 | 8/1993 | Corbin et al. | 355/260 |
| 5,257,076 | 10/1993 | Nishimura et al. . | |
| 5,287,151 | 2/1994 | Sugiyama | 355/260 |
| 5,317,369 | 5/1994 | Nakanishi | 355/246 X |

FOREIGN PATENT DOCUMENTS

| | | |
|---|---|---|
| 2-64673 | 3/1990 | Japan . |
| 4-77775 | 3/1992 | Japan . |

*Primary Examiner*—R. L. Moses
*Attorney, Agent, or Firm*—Robert E. Bushnell

[57] ABSTRACT

A device for sensing the amount of residual toner in a developing apparatus which uses an electrophotographic developing process. The device incorporates an agitator installed in a housing of the developing apparatus, a support formed at one end of the agitator, a plate rotatably coupled with the support and having a magnet attached at one end thereof, a torsion spring whose one end is fixed on the support and the other end is fixed on the plate, and a reed switch installed at the bottom portion of the housing. The reed switch is turned off when the plate is deflected upward around a hinge pin against the a resistant force of the toner, and the reed switch is turned on when the plate does not encounter a sufficient resistant force from the toner. When the plate is extended and stretched in parallel with the support, and the magnet and the reed switch correspond to each other, the reed switch is activated, indicating a low amount of toner in the housing.

25 Claims, 2 Drawing Sheets

DEVICE FOR SENSING THE AMOUNT OF RESIDUAL TONER OF DEVELOPING APPARATUS

CROSS-REFERENCE TO RELATED APPLICATIONS

This application makes reference to, incorporates the same herein, and claims all benefits incurring under 35 U.S.C. §119 from an application for DEVICE FOR SENSING THE AMOUNT OF RESIDUAL TONER OF DEVELOPING APPARATUS filed in the Korean Industrial Property Office on 31 May 1993 and assigned Ser. No. 9478/1993.

BACKGROUND OF THE INVENTION

The present invention relates to electrophotographic development generally and, more particularly, to a process and device for sensing the amount of residual toner in a developer forming electrostatic latent images during an electrophotographic developing process.

In general, a developing apparatus using an electrophotographic developing process such as a laser beam printer, copying machine, plain paper facsimile or the like, serves to form an electrostatic latent image with toner on an exterior circumferential surface of a photosensitive drum, thus playing an important role in determining the quality of the electrostatic latent image quality. If the amount of toner stored in the developing apparatus falls below a predetermined amount as a result of its consumption, a toner-empty state is indicated by a sensor. Devices for sensing the amount of residual toner of in conventional designs of electrophotographic developing apparatus are usually provided with a toner container on the top portion of a housing in the developing apparatus, and with an agitator for preventing toner cohesion in the bottom portion of the housing. The agitator has arms for conveying toner to a developing roller. Typically, a piezoelectric sensor is positioned at the bottom inside portion of the housing to sense the amount of residual toner beneath the agitator. A blade is installed at the top portion of the developing roller to control the height, and thus the quantity of the toner deposited onto the developing roller. A photosensitive drum is located adjacent to the developing roller.

While the toner is supplied from a toner container to the interior of the housing, the rotation of the agitator prevents; the toner from becoming cohesive and conveys the toner from the interior of the housing to the developing roller. The toner is attracted to the developing roller by a magnetic force. The toner is developed on the photosensitive drum by uniformly adjusting the height of the toner with the blade, which controls the height of the toner. During this process, the supply of toner in the housing where the agitator is installed is gradually depleted.

A method for sensing the amount of toner as stated above is disclosed in Takeda et al., U.S. Pat. No. 4,647,185 entitled Developer Detecting Device.

Designs incorporating these features are well known in the art. In order to sense when the supply of toner inside the housing is reduced to a quantity below a reference level, some currently available designs rely upon a piezoelectric sensor changing its output sensing signal level according to the weight of the toner stored in the upper portion. A central processing unit generates a display control signal for displaying a visual indication of a toner-empty state on a display unit in response to the sensing signal produced by the piezoelectric sensor. Other devices for sensing the amount of residual toner in a developing apparatus utilize a reed switch activated by a magnetic field.

An early design, represented by Nawata, U.S. Pat. No. 4,951,091, Image Forming Apparatus Having Toner Quantity Detection Means, describes a developing apparatus incorporating a reed switch and a magnet to sense when the supply of toner is low. The magnet is attached to a plate, which is normally surrounded by toner when the housing is full. A lever, also surrounded by the toner, influences the plate as toner is depleted from the developing apparatus. When a predetermined amount of toner remains, the magnet is no longer surrounded by toner and the lever forces the plate towards the reed switch. The reed switch is activated by the magnetic field produced by the magnet and an indication that the toner is low is conveyed to the user.

A more recent design such as that shown in Nishimura et al., U.S. Pat. No. 5,257,076, entitled Toner Feeding Device Capable Of Signalling Need To Replenish Toner, has a multichambered toner housing incorporating reed switch responsive to a magnetic field. To determine when toner needs to be replenished, a hinged plate with a magnet fixed to the plate rests on top of toner contained within the housing of the developing apparatus. As the toner in the housing is depleted, gravity forces the plate to fall with the diminishing supply of toner. After the plate falls by a predetermined distance, the magnet trips a reed switch positioned in the housing, to indicate that the toner needs to be replenished.

An improved method is disclosed in U.S. application Ser. No. 07/989,828, which is entitled as Device For Detecting Toner Using An Electrophotographic Machine, assigned to SamSung Electronics Co., Ltd. This improved method utilizes a metal plate which rides on the toner contained in a hopper. As the toner is depleted, the metal plate moves with the surface of the toner. Finally, as the toner is completely depleted the metal plate rests upon the bottom portion of the hopper and attracts a magnet attached to one end of a bell crank, situated below the hopper. As the magnet is pulled toward the hopper and metal plate, the other end of the bell crank covers a photosensor to detect an empty state of toner in an electrophotographic machine.

I have observed various deficiencies in conventional developing devices such as those described above. The piezoelectric sensor used to sense the amount of residual toner is generally high in cost, a factor that contributes to unwarranted restriction upon a manufacturer's market share due to uncompetitively high prices of the finished product; moreover, such sensors tend to be sensitive to environmental conditions. Additionally, due to its sensitivity, the piezoelectric sensor must be carefully placed and left undisturbed where the toner is sensed; this is an unweildly restriction upon a manufacturer's freedom of design that can result in a less than optimal configuration of the toner hopper. As a result of its location inside the hopper, the sensor creates a protuberance and inhibits toner from smoothly circulating through the hopper. In addition to these problems attributable to conventional designs, the piezoelectric sensor generates undesirable vibration and noise due to its own characteristics.

Moreover, the developing devices which use a reed switch or a photosensor utilize a separate plate to move with the toner and trip the reed switch or photosensor to indicate when toner is low. The separate plate may become jammed and uses space in the housing which contains the toner. Additionally, these conventional devices must utilize a separate means to agitate the toner in the housing.

SUMMARY OF THE INVENTION

It is therefore one object of the present invention to provide an improved device and process for sensing the amount of residual toner in an electrostatic developing apparatus.

It is another object to provide a device and process able to reliably indicate depletion of the supply of toner in the interior of an electrostatic developing apparatus.

It is still another object to provide a device and process for sensing the amount of residual toner in an electrostatic developing apparatus supplying toner to a photosensitive drum.

It is still yet another object to provide a device and process for facilitating the maintenance of density of an electrostatic latent image by a developing roller of an electrostatic developing apparatus.

It is also an object to provide a simpler device and process for indicating depletion of the supply of toner for an electrostatic developing apparatus.

These and other objects may be achieved according to the principles of the present invention with a device and process for sensing the amount of toner in a developing apparatus having a hopper for containing toner. A developing roller is positioned outside the hopper for receiving the toner and a photosensitive drum is positioned near the developing roller for receiving the toner in the form of an electrostatic latent image. An agitator is located in the hopper and mounted on a rotatable shaft for rotating through the toner in the direction of rotation to agitate the toner. A support arm is fixed to radially extend from the rotatable shaft; a pin mounts a plate to the distal end of the support arm. The plate has a free edge, an exposed side and a plane extending from the exposed side that is rotatably coupled by the pin at a fixed edge so that the plane may not extend past the support axis in the direction of rotation. The exposed side faces the toner as the rotatable shaft revolves within the hopper. A biasing element is interposed between the support and the plate to force the plane extending from plate to extend parallel with the support axis and allow the plane extending from the plate to deflect in a direction opposite to the direction of rotation in response to a force directed upon the exposed side of the plate by toner within the hopper. A magnet is mounted on the free edge of the plate, and a switch is mounted on the lower portion of the hopper to respond to the magnet when a combination of rotation of the agitator and depletion of the toner within the hopper enable the plate to bring the magnet sufficiently close to the switch, thereby causing the switch to toggle between two operational signal modes and thus indicate a low toner condition.

Another embodiment of the device incorporates a resistive film covering the exposed side of the plate to create an increased amount of resistance between the exposed side of the plate and the toner as the plate rotates through the toner.

The method for detecting a predetermined amount of toner in a developing apparatus contemplates rotation of a sensitive arm attached to the shaft of an agitator, between a deflected position under force caused by resistance of toner within the hopper as the agitator draws the plate through the toner, and a radially aligned position as the combined rotation of the agitator and depletion of toner within the hopper enables the sensitive arm to place the magnet within a threshold distance sufficient to toggle the switch as the magnet rotates past the switch.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, wherein.

DETAILED DESCRIPTION OF THE PREFERRED EMBODIMENT

Figure 1:
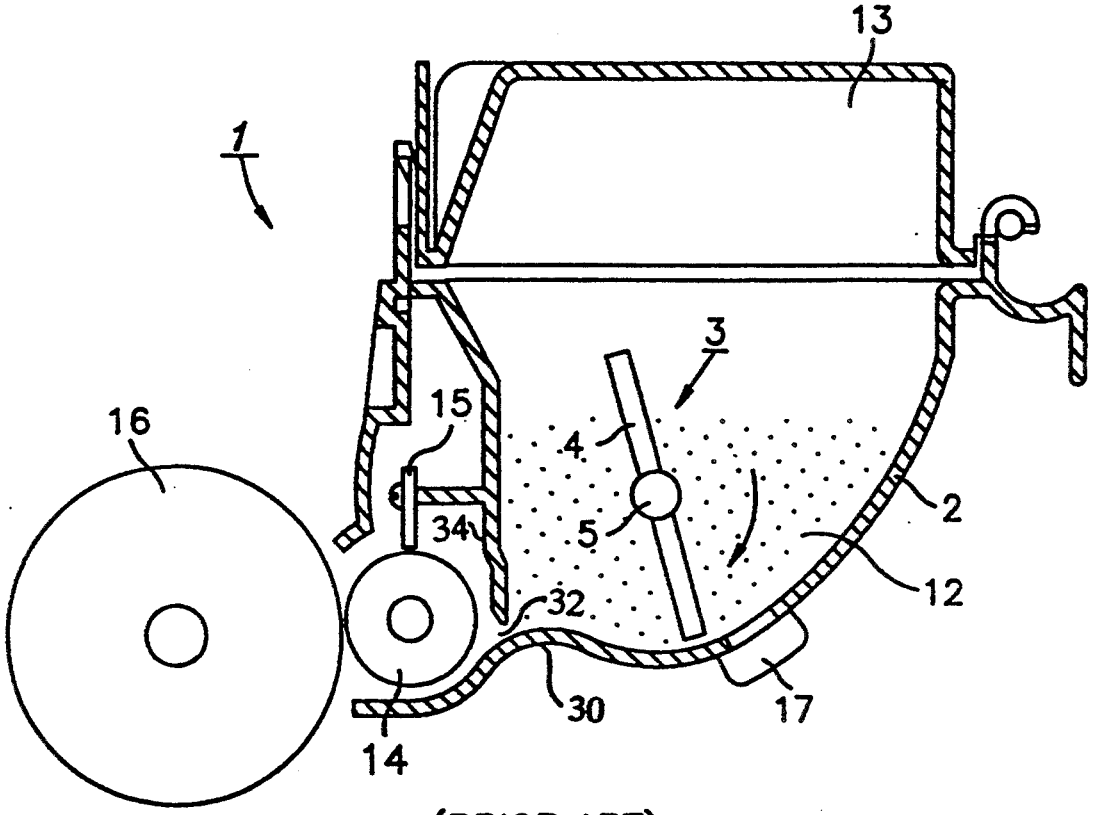
(PRIOR ART) FIG. 1
FIG. 1 shows a side cross-sectional view of a device for sensing the amount of residual toner in a conventional developing apparatus.

Turning now to the drawings, a conventional device for sensing the amount of residual toner in the conventional developing assembly 1 as shown in FIG. 1, is provided with a toner container 13 on the top portion of a housing providing a hopper 2 in developing assembly 1, and with an agitator 3 extending across the lower interior region of hopper 2 to prevent cohesion of toner in the bottom portion of hopper 2. Agitator 3 has a pair of diametrically opposed arms 4 conveying toner 12 from the lower interior region of hopper 2, across a ridge 30 formed by the floor of hopper 2, and through an orifice 32 formed between the outer downward side of ridge 30 and a vertical wall 34 of hopper 2, in order to supply a controllable quantity of toner from hopper 2 to a developing roller 14 installed between orifice 32 and a photosensitive drum 16. A piezoelectric sensor 17 for sensing the amount of residual toner is disposed on the hopper 2 at the bottom portion of the agitator 3. A blade 15 at the top portion of the developing roller 14 is installed to control the height of toner 12 deposited on the exterior circumferential surface of a developing roller 14 and subsequently onto the exterior photosensitive circumferential surface of drum 16 positioned with its longitudinal axis parallel to the longitudinal axis of roller 14.

While toner 12 is supplied from a toner container 13 to the interior of hopper 2 in the above developing assembly 1, rotation of agitator 3 prevents toner 12 from becoming cohesive and conveys toner 12 in the interior of hopper 2 to developing roller 14. Toner 12 is attracted to developing roller 14 by a magnetic force. Toner 12 is developed on photosensitive drum 16 by adjusting disbursement of toner from hopper 2 to a uniform height of toner with blade 15; in effect, blade 15 controls the height of toner 12 deposited onto roller 12. During this process, the amount of toner in hopper 2 where agitator 3 is installed is gradually depleted. The technique mentioned above is well known in the art.

To sense the amount of toner in hopper 2 when the amount of toner is depleted to below a reference level, piezoelectric sensor 17 changes signal level according to the weight of the toner stored in the upper portion to sense the amount of the toner. In response to the sensing signal produced by piezoelectric sensor 17, a central processing unit CPU (not shown) generates a display control signal for displaying an indication of a toner-empty state by displaying the indication on a display unit as a visual representation of that indication.

The preferred embodiment of the device for sensing the amount of toner in the developing assembly constructed according to the present invention will now be described with reference to FIGS. 2, 3 and 4.

Figure 2:
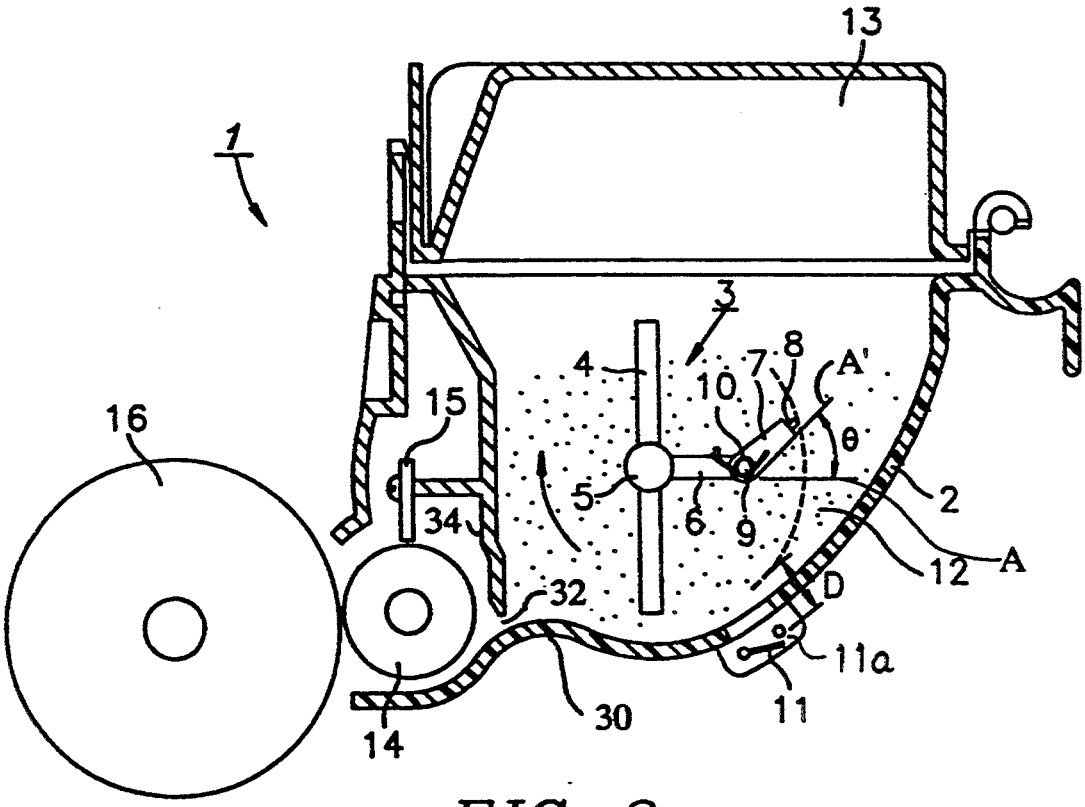
FIG. 2 shows a side cross-sectional view of a device for sensing the amount of residual toner in a developing apparatus constructed according to the principles of the present invention.
Figure 3:
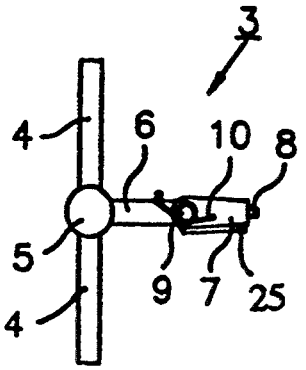
FIG. 3 shows one detailed side view of an agitator constructed according to the principles of the present invention.

FIG. 2 shows a device for sensing the amount of residual toner in a developing assembly constructed according to the principles of the present invention. Agitator 3 installed inside hopper 2 of the developing assembly 1 has a pair of radially extending, diametrically opposed arms 4 at the top and bottom, centered around a central hub 5, and a arm 6 extending radially outward from hub 5. Hopper 2 is constructed of a non-ferromagnetic material. Arm 6, having a radial length less than the longest on the remaining arms is connected to a hinge pin 9 to rotate a plate 7 which has a magnet 8 attached at the outer end portion of arm 6 and a proximal end rotatably coupled to extend outwardly from a distal portion of arm 6. One end of a torsion spring 10 is fixed to arm 6, and the other end of torsion spring 10 is fixed to plate 7. A longitudinal axis A' extends radially from pin 9 through plate 7, while an axis A extends from the longitudinal axis of hub 5 through arm 6. A reed switch 11, which operates and is activated under magnetic force, is installed at the bottom portion of hopper 2. The distance from hub 5 to any portion of the hopper 2 is longer than the longest one of arms 4. When magnet 8 attached to plate 7 of agitator 3 is positioned above the magnetically responsive actuator arm of reed switch 11, the arm of reed switch 11 operates by moving to allow its distil end to make electrical contact with pole 11*a* in order to indicate that magnet 8 has passed within a threshold distance from the magnetically responsive actuator arm, thereby indicating that the sensitive arm formed by arm 6 and plate 7 has sensed that the amount of residual toner in hopper 2 is low. In effect, the combination of rotation of the agitator, reduction of the counter-force resisting movement of plate 7 through depletion of toner within the hopper, and the urging of plate 7 toward radial alignment with the radial axis of arm 6 by spring 10, enables this sensitive arm to trigger switch 11 to move from one operational mode to a second operational mode to initiate a visual display representing a toner low condition during the second operational mode.

Plate 7 of agitator 3, centered around hinge pin 9 which is rotatably coupled to the arm 6, is capable of moving up and down in response to the pressure of toner 12 against plate 7 created as the agitator 3 rotates in toner 12.

In order for plate 7 to create sufficient resistance while rotating through toner 12, the dimension of plate 7 in the rotating direction is large. To create a greater resistance, a film 25, as shown in FIG. 3, may be attached to plate 7 in the rotating direction.

A preferred embodiment of the present invention will be hereinafter explained. The reference numerals (not previously explained) of the attached drawings of the present invention are the same reference numerals as used with the explanation of the conventional art.

As toner 12 is supplied from toner container 13 to the interior of hopper 2, agitator 3 is rotated in the clockwise direction around hub 5, and, plate 7 coupled with arm 6 of agitator 3, or axis A and A', forms an angle of $\theta$, shown in FIG. 2, in the upstream direction, centering around hinge pin 7. As agitator 3 is rotated, the torsion spring 10 installed in arm 6 and plate 7 becomes resilient to the rotation. Torsion spring 10 urges plate 7 to extend in radial alignment with arm 6 to place the magnetic threshold in proximity to reed switch 11. In order for plate 7 to provide a sufficient resistance as it travels through toner 12, the dimension of plate 7 in the rotating direction may be large, or to produce a greater resistance, a film is attached to plate 7 in the rotating direction. If constructed as explained above, plate 7 is resisted by toner 12 as it travels through toner 12, and is easily set in the counter direction of rotation of agitator 3, so the stability in operating plate 7 can be ensured.

At this time, arms 4 of agitator 3 rotate simultaneously with plate 7 having magnet 8 attached at one end. Magnet 8 attached at one end of plate 7 rotates while maintaining a cycle such as a dotted-line of FIG. 2. When magnet 8 rotates around reed switch 11 disposed at the bottom portion of hopper 2, the action direction of the magnetic force in the distance "d" between the magnet 8 and the reed switch 11, does not directly correspond to the reed switch 11. Since the magnetic force is in inverse proportion to distance, the magnetic force of the magnet 8 is not strong enough to draw reed switch 11 toward magnet 8 and to thereby close the electrical circuit between reed switch 11 and switch contact pole 11*a* necessary to turn on the reed switch 11. As a result, the reed switch 11, which senses the amount of residual toner does not operate, or close, and remains in an open circuit condition as shown in FIG. 2.

As the agitator 3 is rotated around hub 5, the arms 4, arm 6 and plate 7 are rotated simultaneously. Thus, toner 12 is prevented from being cohesive and a constant electric charge is formed by the generation of static electricity produced by the friction between plate 7 and the toner 12. As a result, toner 12 is conveyed to developing roller 14 positioned at one end portion of hopper 2, and toner 12 is attached to developing roller 14 by a magnetic force.

While the height of toner 12 attached to developing roller 14 is constantly maintained by blade 15, which is installed separately from the top portion of developing roller 14, developing roller 14 is rotated and the toner is thereafter attached to an electric latent image formed on the surface of photosensitive drum 16 installed at one end portion of hopper 2, thereby executing the development of toner 12.

Figure 4:
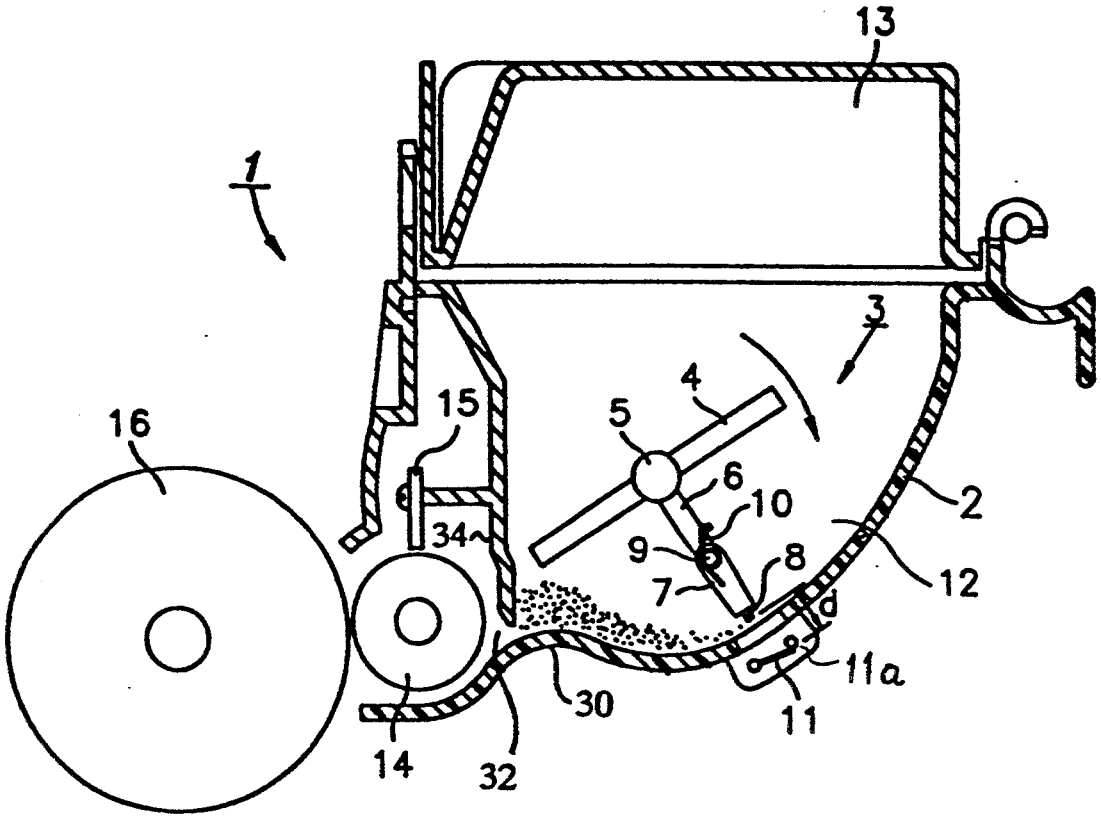
FIG. 4 shows a side cross-sectional view illustrating an operational state of a device for sensing the amount of residual toner in a developing apparatus constructed according to the principles of the present invention.

Referring now to FIG. 4, when the amount of toner 12 in the interior of hopper 2 decreases to a low level as the developing assembly 1 operates as discussed above, plate 7 centered around hinge pin 9 by the resilient force of torsion spring 10 disposed in arm 6 of the agitator 3 is returned in parallel with arm 6 as the resistant force created by toner 12 is reduced during rotation of agitator 3. Then, as arms 4 of agitator 3, arm 6 and plate 7 are rotated simultaneously, the distance "d" between magnet 8 attached at the end portion of the plate 6 and reed switch 11 becomes less as the rotation of magnet 8 moves magnet 8 closer to reed switch 11 and, the direction of attraction the magnetic force corresponds directly with reed switch 11. Since the magnitude of the magnetic force is in inversely proportional to distance between magnet 8 and reed switch 11, the magnetic force created by magnet 8 is only sufficiently strong enough to pull reed switch 11 against pole 11*a* when depletion of toner 12 within hopper 2 enables the respective longitudinal axes of arm 6 and plate 7 to become coaxially aligned under the influence of bias spring 10 and rotation of agitator 3 places magnet 8 nearest to reed switch 11, thereby closing the electrical circuit passing through reed switch 11 and pole 11*a*, and turning on the reed switch 11 to enable indication of a low amount of residual toner. In this case, when reed switch 11 produces an on state sensing signal, a central processing unit CPU (not shown) acknowledges that the amount of toner has been exhausted and that hopper 2 is nearly empty, and generates a display control signal for displaying an indication of a toner-empty state on the display unit.

After the quantity of toner 12 in hopper 2 has been nearly consumed, whenever magnet 8 of plate 7 is close to reed switch 11 during the rotation of agitator 3, reed switch 11 is turned on by the magnetic force of magnet 8 to send a sensing signal to the CPU. That is, the on-state sensing signal of reed switch 11 is sensed every time that agitator 3 is rotated while the supply of toner 12 within hopper remains in a nearly depleted state.

According to another embodiment of the device, the magnet is positioned at the portion of the reed switch 11, or alternatively, magnets oriented to exhibit opposite polarity may be attached to both the plate 7 and the reed switch 11. That is, the magnetic force is in inverse proportional to distance between the magnet 8 and the reed switch 11 so as to generate the magnetism, the number of magnets and their relative position are not so critical. In the above embodiment, it is possible that reed switch 11 can itself be magnetized to and orientated with a complementary polarity to close whenever either a magnet 8 or a mass of an ion material on the distal portion of plate 7 makes its closest approach to the arm of reed switch 11.

As discussed above, there is provided a device for sensing the amount of residual toner in which a magnet is attached to an agitator rotated in the inner of developing apparatus, and a reed switch is disposed at the bottom portion of the housing, so that the device has such advantages capable of informing users of the time when the supply of toner is necessary and providing the manufacturing price lower than that in using a conventional piezoelectric sensor.

What is claimed is:

1. A device for sensing residual toner within a developer assembly using an electrophotographic developing process, said device comprising:

an agitator installed to rotate around an axis through toner held within a hopper of the developer assembly;

a first arm of said agitator extending radially outwardly from said axis;

a plate rotatably coupled with a distal portion of said first arm;

a magnet attached to a distal region of said plate; and a switch installed at a bottom portion of the hopper to exhibit a first operational state while toner within the bottom portion of the hopper displaces said plate out of radial alignment with said first arm while said agitator revolves about said axis within the hopper, and to exhibit a second operational state when substantial radial alignment between said plate and said first arm enables said magnet to pass within threshold proximity to said switching means while said agitator revolves about said axis within the hopper.

2. The device of claim 1, further comprised of means engaging said distal portion of said first arm and said plate, for biasing said plate toward said radial alignment with said first arm.

3. The device of claim 1, further comprised of:

said agitator exhibiting a direction of rotation as said agitator revolves about said axis within the hopper; and said plate exhibiting a leading major surface defining a plane extending substantially perpendicularly to said direction.

4. The device of claim 1, further comprised of:

said plate having a leading major surface oriented to engage said toner as said agitator revolves about said axis within the hopper, and means covering said leading surface, for increasing resistance between said leading major surface and the toner while said agitator revolves about said axis within the hopper.

5. The device of claim 3, further comprised of:

said leading major surface being oriented to engage said toner as said agitator revolves about said axis within said hopper, and means covering said leading surface, for increasing resistance between said leading major surface and the toner while said agitator revolves about said axis within the hopper.

6. The device of claim 1, further comprised of:

said agitator exhibiting a first direction of rotation as said agitator revolves about said axis within said hopper;

said plate exhibiting a leading major surface defining a plane extending substantially perpendicularly to said direction;

means coupling said plate to said distal portion of said arm, for enabling said plate to rotate in a second and opposite direction when said leading major surface engages the toner while said agitator revolves about said axis within the hopper; and means engaging said distal portion of said first arm and said plate, for urging said plate to rotate in said first direction as the toner is depleted from the hopper.

7. A device for sensing residual toner in a developer assembly of an electrophotographic developing process, comprising:

an agitator having a central hub mounted upon an axis, and a plurality of arms extending radially outwardly from said hub, said agitator being positionable to revolve about said axis within a hopper containing the toner while said arms engage said toner within the hopper and facilitate discharge of the toner from the hopper during said process;

a first one of said arms having a radial length less than a longest one of said arms;

a plate having a proximal end rotatably coupled to extend outwardly from a distal portion of said first one of said arms;

a magnet attached to a distal end of said plate;

switching means installed at the bottom portion of said housing, for operationally responding to passage of said magnet by providing an output signal variation whenever said magnet passes a threshold proximity to said switching means; and means interposed between said distal portion and said proximal end, for urging said plate to extend in radial alignment with said first one of said arms to place said magnet in said threshold proximity to said switching means as said agitator revolves about said axis within the hopper.

8. The device of claim 7, further comprised of a least distance between said axis and the bottom portion of the hopper being greater than said radial length of said longest one of said arms.

9. The device of claim 7, further comprised of said switching means exhibiting a first operational state while engagement between said plate and toner within the bottom portion of the hopper during rotation of said agitator around said axis causes said plate to rotate out of said radial alignment with said first one of said arms.

10. The device of claim 7, further comprised of said switching means exhibiting a first operational state while said interposed means places a longitudinal axis of said plate substantially in said radial alignment.

11. The device of claim 10, further comprised of said switching means exhibiting a second operational state distinct from said first operational state while said interposed means places a longitudinal axis of said plate substantially in said radial alignment.

12. The device of claim 7, further comprised of said plate exhibiting a first operational position relative to said first one of said arms while engagement between said plate and toner within the bottom portion of the hopper during rotation of said agitator around said axis causes said plate to rotate out of said radial alignment with said first one of said arms.

13. The device of claim 7, further comprised of said plate exhibiting a first operational position while said interposed means places a longitudinal axis of said plate substantially in said radial alignment with said passing said threshold proximity to said switching means.

14. The device of claim 12, further comprised of said plate exhibiting a second operational position distinct from said first operational position while said interposed means places a longitudinal axis of said plate substantially in said radial alignment with said passing said threshold proximity to said switching means.

15. The device of claim 13, further comprised of said switching means exhibiting a second operational state distinct from said first operational state while said interposed means places a longitudinal axis of said plate substantially in said radial alignment.

16. A method of detecting a predetermined amount of toner in a developing apparatus having a housing for containing said toner, an agitator located in said housing and mounted on a rotatable shaft for rotating through said toner in a direction of rotation to agitate said toner, a sensing means attached to said rotatable shaft having a plate at an original position with an activating means attached to said plate and a switching means located on a lower portion of said housing, comprising:

rotating said sensing means through said toner contained in said housing;

deflecting said plate away from said original position in a direction opposite a direction of rotation to create a distance between said activating means and said switching means proportional to a force exerted upon said plate by said toner as said plate rotates through said toner and passes by said switching means;

returning said plate substantially to said original position as said force exerted upon said plate by said toner as said plate rotates through said toner decreases as said toner diminishes in capacity from said housing; and activating said switching means when said activating means is positioned at a substantially close distance to said switching means.

17. A sensing apparatus for sensing the amount of toner in a developing apparatus, comprising:

a housing for containing said toner;

a developing roller positioned outside said housing for receiving said toner;

a photosensitive drum positioned to receive said toner in a form of an electrostatic latent image from said developing roller;

an agitator located in said housing and mounted on a rotatable shaft for rotating through said toner in a direction of rotation to agitate said toner;

a support fixed to and extending from said rotatable shaft, said support is fixed to said rotatable shaft at a fixing point, having a distal end opposite said fixing point and having a support axis extending from said distal end;

a hinge pin mounted on said distal end of said support;

a plate having a free edge, a fixed edge, an exposed side and a plane extending from said exposed side, said plate rotatably mounted to said hinge pin at said fixed edge such that said plane may not extend past said support axis in said direction of rotation and said exposed side faces said toner as said rotatable shaft rotates;

a flexing means fixed to said support and said plate, such that said flexing means forces said plane extending from said plate to extend in parallel with said support axis and allows said plane extending from said plate to deflect in a direction opposite said direction of rotation in response to a sufficient force directed upon said exposed side of said plate, said sufficient force resulting from said toner as said plate rotates through said toner;

an activation means mounted to said free edge of said plate; and a switching means mounted on a lower portion of said housing, said switching means responsive to said activation means when said activation means is substantially close to said switching means.

18. A sensing apparatus as claimed in claim 17, said flexing means comprises a torsion spring.

19. A sensing apparatus as claimed in claim 17, said activation means comprises a magnet.

20. A sensing apparatus as claimed in claim 17, said switching means comprises a reed switch.

21. A sensing apparatus as claimed in claim 17, further comprising a resistive film covering said exposed side of said plate, for creating an increased amount of resistance between said exposed side of said plate and said toner as said plate rotates through said toner.

22. A sensing apparatus for sensing the amount of toner in a developing apparatus, comprising:

a housing for containing said toner;

a developing roller positioned outside said housing for receiving said toner;

a photosensitive drum positioned to receive said toner in a form of an electrostatic latent image from said developing roller;

an agitator located in said housing and mounted on a rotatable shaft for rotating through said toner in a direction of rotation to agitate said toner;

a support fixed to and extending from said rotatable shaft, wherein said support is fixed to said rotatable shaft at a fixing point, has a distal end opposite said fixing point and has a support axis extending from said distal end;

a hinge pin mounted on said distal end of said support;

a plate having a free edge, a fixed edge, an exposed side and a plane extending from said exposed side, said plate is rotatably mounted to said hinge pin at said fixed edge such that said plane may not extend past said support axis in said direction of rotation and said exposed side faces said toner as said rotatable shaft rotates;

a flexing means fixed to said support and said plate, such that said flexing means forces said plane extending from said plate to extend in parallel with said support axis and allows said plane extending from said plate to form an angle with said support axis by deflecting said plane in a direction opposite said direction of rotation in response to a resistance created between said exposed side of said plate and said toner as said plate rotates through said toner to create a sufficient force directed upon said exposed side of said plate;

a resistive film covering said exposed side of said plate, for creating an increased amount of resistance between said exposed side of said plate and said toner as said plate rotates through said toner;

an activation means mounted to said free edge of said plate; and a switching means mounted on a lower portion of said housing, said switching means is responsive to said activation means when said activation means is substantially close to said switching means.

23. A sensing apparatus as claimed in claim 22, said flexing means comprises a hinge pin.

24. A sensing apparatus as claimed in claim 22, said activation means comprises a magnet.

25. A sensing apparatus as claimed in claim 22, said switching means comprises a reed switch.

* * * * *

UNITED STATES PATENT AND TRADEMARK OFFICE

CERTIFICATE OF CORRECTION

PATENT NO. :5,436,704
DATED :25 July 1995
INVENTOR(S) :Young-Soo Moon

It is certified that error appears in the above-indentified patent and that said Letters Patent is hereby corrected as shown below:

Column 1, Line48, after "prevents" delete semicolon ";":

Signed and Sealed this

Twenty-ninth Day of July, 1997

Bruce Lehman

*Attest:*

BRUCE LEHMAN

*Attesting Officer*

*Commissioner of Patents and Trademarks*